US012551753B2

(12) United States Patent
Rei

(10) Patent No.: US 12,551,753 B2
(45) Date of Patent: Feb. 17, 2026

(54) MULTI-USE STRENGTH TRAINING DEVICE FOR ARMWRESLTERS

(71) Applicant: Lukas Rei, Norton, MA (US)

(72) Inventor: Lukas Rei, Norton, MA (US)

( * ) Notice: Subject to any disclaimer, the term of this patent is extended or adjusted under 35 U.S.C. 154(b) by 0 days.

(21) Appl. No.: 18/744,045

(22) Filed: Jun. 14, 2024

(65) Prior Publication Data

US 2025/0381442 A1 Dec. 18, 2025

(51) Int. Cl.

| | |
|---|---|
| ***A63B 23/12*** | (2006.01) |
| ***A63B 21/00*** | (2006.01) |
| ***A63B 21/062*** | (2006.01) |
| ***A63B 23/14*** | (2006.01) |

(52) U.S. Cl.

CPC ..... *A63B 23/129* (2013.01); *A63B 21/0626* (2015.10); *A63B 21/154* (2013.01); *A63B 21/4035* (2015.10); *A63B 23/14* (2013.01); *A63B 2214/00* (2020.08); *A63B 2225/093* (2013.01); *A63B 2225/102* (2013.01)

(58) Field of Classification Search

CPC ..... A63B 21/0626; A63B 21/154; A63B 21/4035; A63B 23/129; A63B 23/14; A63B 2214/00; A63B 2225/093; A63B 2225/102

See application file for complete search history.

(56) References Cited

U.S. PATENT DOCUMENTS

| | | | | |
|---|---|---|---|---|
| 332,989 A | | 12/1885 | Benedict | |
| 4,258,913 A | * | 3/1981 | Brentham | A63B 21/0083 482/45 |
| 5,902,218 A | | 5/1999 | Froelich | |
| 5,967,949 A | * | 10/1999 | Davenport | A63B 21/153 482/99 |
| 6,019,704 A | * | 2/2000 | Morgan | A63B 23/14 482/99 |
| 6,099,437 A | | 8/2000 | DeMers | |
| 6,234,934 B1 | | 5/2001 | Gorczyca | |
| 6,312,359 B1 | | 11/2001 | Brundle | |

(Continued)

FOREIGN PATENT DOCUMENTS

| | | |
|---|---|---|
| KR | 10-1158732 | 7/2012 |
| WO | 2023/274738 | 1/2023 |

OTHER PUBLICATIONS

Atlantis Strength Inc., Multi-forearm Model A201, https://atlantisstrength.com/gym-equipment/a201, Quebec, Canada.

*Primary Examiner* — Joshua Lee

(74) *Attorney, Agent, or Firm* — Lambert Shortell & Connaughton; David J. Connaughton, Jr.; Justin P. Tinger

(57) ABSTRACT

The present disclosure teaches a multi-use strength training device for arm-wrestlers. The device may include a forearm-and-wrist roller mounted onto a pole. The roller includes a bar that may rotate about its central axis; a first pair of handles, which may be implemented by wrapping two pieces of textured material around the bar on each side of its midpoint; and a second pair of handles attached to each end of the bar, which are perpendicular to the bar. A rope connects the midpoint of the bar and a weight assembly via a pulley. The weight assembly may move along another pole. When a trainer turns the bar in either direction, the first rope may wrap around the bar and pull the weight assembly up. A trainer can also pull the weight assembly up via a grip or a handle connected to the weight assembly via another rope.

20 Claims, 8 Drawing Sheets

(56) References Cited

U.S. PATENT DOCUMENTS

| | | | | |
|---|---|---|---|---|
| 7,029,432 | B2 | 4/2006 | Lear | |
| 7,753,827 | B1 | 7/2010 | Emick | |
| 8,083,656 | B2 * | 12/2011 | Suiter | A63B 21/154 482/130 |
| 8,920,293 | B1 | 12/2014 | Rosaly | |
| 9,132,315 | B1 | 9/2015 | Chen | |
| 9,610,470 | B1 | 4/2017 | Eshet | |
| 10,071,280 | B2 | 9/2018 | King | |
| 10,300,331 | B2 * | 5/2019 | Seltzer | A63B 23/03516 |
| 10,549,152 | B2 | 2/2020 | Walker | |
| 10,596,412 | B2 | 3/2020 | Sinclair | |
| 10,646,748 | B1 * | 5/2020 | Bernotas | A63B 21/4049 |
| 10,870,032 | B2 | 12/2020 | Bardakci | |
| 11,779,806 | B1 * | 10/2023 | Morgan | A63B 21/0628 482/46 |
| 2006/0166797 | A1 * | 7/2006 | Hamer | A63B 21/055 482/121 |
| 2015/0297947 | A1 | 10/2015 | Morton | |
| 2017/0043205 | A1 | 2/2017 | Wilson | |
| 2024/0299800 | A1 * | 9/2024 | Bardunias | A63B 23/1281 |

* cited by examiner

MULTI-USE STRENGTH TRAINING DEVICE FOR ARMWRESLTERS

TECHNICAL FIELD

The present disclosure relates to the field of fitness training devices and equipment.

BACKGROUND

Arm-wrestling is a sport with two opponents who face each other with their bent elbows placed on a table and hands firmly gripped, who then attempt to force the opponent's hand down to the tabletop. Wrist and forearm strength is vital in the game of arm-wrestling. Since arm-wrestling is a niche sport, not many training devices have been developed to cater to an arm-wrestler's specific needs.

One of the commonly used strength training devices for forearm and wrist muscles is a forearm-and-wrist roller. State-of-the-art forearm-and-wrist rollers are stand-alone pieces of equipment that cannot be mounted onto a base. Thus, they require a trainer to support the weight of the roller by themselves while exercising, which puts strain on their shoulders and upper arms and directs their focus away from the movements of the forearms and wrists. Moreover, some state-of-the-art forearm-and-wrist rollers have features that allow a trainer to clip weights onto a rope attached to the midpoint of the roller. However, this method of weight adjustment is neither consistent nor sturdy. Hence, it could be helpful to introduce a training device that (1) can be stabilized onto an external structure; and (2) comes with an improved method of weight adjustment.

Additionally, state-of-the-art forearm-and-wrist rollers only provide one way of exercising muscles in the forearm and wrist arca. It could also be helpful to introduce a multi-use device that allows different methods of strengthening different groups of muscles that are used in the sport of arm-wrestling.

SUMMARY

The present disclosure teaches a multi-use strength training device for arm-wrestlers, comprising: a forearm-and-wrist roller fixedly mounted onto a first vertical pole, which further includes: a first horizontal bar able to rotate about a central axis; a first pair of handles on and aligning with the first horizontal bar, on each side of a midpoint of the first horizontal bar; a second pair of handles respectively attached to each end of the first horizontal bar and perpendicular to the first horizontal bar; a first rope connecting the midpoint of the first horizontal bar and a weight assembly via a first fixed pulley; wherein, the weight assembly is able to move along a second vertical pole; wherein, the first fixed pulley is mounted onto the second vertical pole; wherein, when the first horizontal bar rotates in either direction, the first rope wraps around the first horizontal bar at the midpoint of the first horizontal bar, and pulls the weight assembly up along the second vertical pole; wherein, when a tension in the first rope gets released, gravity drags the weight assembly down along the second vertical pole, which in turn unwraps the first rope around the first horizontal bar, and rotates the first horizontal bar; wherein, a weight in the weight assembly is adjustable; a second rope, with one end detachably connecting to the weight assembly and the other end detachably connecting to a grip or a third handle via one or more second fixed pulleys; wherein, the one or more second fixed pulleys are mounted onto the second vertical pole.

In some embodiments, the first pair of handles is formed by wrapping two pieces of textured materials around the first horizontal bar.

In some embodiments, the grip is a stripe of textured material.

In some embodiments, the third handle is perpendicular to a direction of tension in the second rope when the second rope is tightened.

In some embodiments, the presently disclosed technology further includes a third vertical pole, wherein a cushion is mounted onto the third vertical pole.

In some embodiments, the third vertical pole is telescopic with an adjustable height.

In some embodiments, a set of weight plates can be placed onto or removed from the weight assembly to adjust the weight in the weight assembly.

In some embodiments, the weight assembly further includes: a guideway enabling the weight assembly to move along the second vertical pole; a third horizontal bar attached to the guideway; wherein, the set of weight plates can be placed onto or removed from the third horizontal bar.

In some embodiments, the second rope is detachably connected to the weight assembly via a first clip.

In some embodiments, the second rope is detachably connected to the grip or the third handle via a second clip.

In some embodiments, the presently disclosed technology further comprises one or more supporting bars connecting two or all of the first vertical pole, the second vertical pole, and the third vertical pole.

In some embodiments, the first vertical pole, the second vertical pole, and the third vertical pole are mounted onto a base comprising one or more base pieces.

In some embodiments, the presently disclosed technology further includes a first supporting bar connecting the first vertical pole and the second vertical pole.

In some embodiments, the weight assembly is supported by the first supporting bar at a bottommost position of the weight assembly. In some embodiments, the presently disclosed technology further includes a second supporting bar connecting the first vertical pole and the third vertical pole.

The presently disclosed technology also teaches a method of training for arm-wrestlers on a multi-use strength training device, comprising: wherein the multi-use strength training device includes: a forearm-and-wrist roller fixedly mounted onto a first vertical pole, which further includes: a first horizontal bar able to rotate about a central axis; two pieces of textured materials wrapped around the first horizontal bar on each side of a midpoint of the first horizontal bar, forming a first pair of handles; a second pair of handles respectively attached to each end of the first horizontal bar and perpendicular to the first horizontal bar; a first rope connecting the midpoint of the first horizontal bar and a weight assembly via a first fixed pulley; wherein, the weight assembly is able to move along a second vertical pole; wherein, the first fixed pulley is attached to a bottom side of a second horizontal bar, which is attached to a top of the second vertical pole; wherein, when the first horizontal bar rotates in either direction, the first rope wraps around the first horizontal bar at the midpoint of the first horizontal bar, and pulls the weight assembly up along the second vertical pole; wherein, when a tension in the first rope gets released, gravity drags the weight assembly down along the second vertical pole, which in turn unwraps the first rope around the first horizontal bar, and rotates the first horizontal bar; wherein, a weight in the weight assembly is adjustable; holding onto the first pair of handles with both hands; rotating the first horizontal bar in either direction, which wraps the first rope around the first horizontal bar and in turn pulls the weight assembly up; releasing the first horizontal bar.

In some embodiments, the releasing of the first horizontal bar further includes: wrapping both hands loosely around the first pair of handles to slow down the downward movement of the weight assembly.

In some embodiments, the weight assembly further includes: a guideway enabling the weight assembly to move along the second vertical pole; a third horizontal bar attached to the guideway; a set of weight plates that can be placed onto or removed from the third horizontal bar to adjust the weight in the weight assembly.

The presently disclosed technology also teaches method of training for arm-wrestlers on a multi-use strength training device, comprising: wherein the multi-use strength training device includes: a forearm-and-wrist roller fixedly mounted onto a first vertical pole, which further includes: a first horizontal bar able to rotate about a central axis; two pieces of textured materials wrapped around the first horizontal bar on each side of a midpoint of the first horizontal bar, forming a first pair of handles; a second pair of handles respectively attached to each end of the first horizontal bar and perpendicular to the first horizontal bar; a first rope connecting the midpoint of the first horizontal bar and a weight assembly via a first fixed pulley; wherein, the weight assembly is able to move along a second vertical pole; wherein, the first fixed pulley is attached to a bottom side of a second horizontal bar, which is attached to a top of the second vertical pole; wherein, when the first horizontal bar rotates in either direction, the first rope wraps around the first horizontal bar at the midpoint of the first horizontal bar, and pulls the weight assembly up along the second vertical pole; wherein, when a tension in the first rope gets released, gravity drags the weight assembly down along the second vertical pole, which in turn unwraps the first rope around the first horizontal bar, and rotates the first horizontal bar; wherein, a weight in the weight assembly is adjustable; standing on one side of the forearm-and-wrist roller; bringing the weight assembly up by using both hands to alternatively rotate a target handle in the second pair of handles in either direction; using one hand to hold the target handle; twisting the first horizontal bar back and forth.

In some embodiments, the weight assembly further includes: a guideway enabling the weight assembly to move along the second vertical pole; a third horizontal bar attached to the guideway; a set of weights that can be placed onto or removed from the third horizontal bar to adjust the weight in the weight assembly.

BRIEF DESCRIPTION OF THE DRAWINGS

The present disclosure is further illustrated by way of exemplary embodiments, which are described in detail through the accompanying drawings. These embodiments are not limiting, and in these embodiments, the same numbering indicates the same structure, wherein.

DETAILED DESCRIPTION

Figure 1:
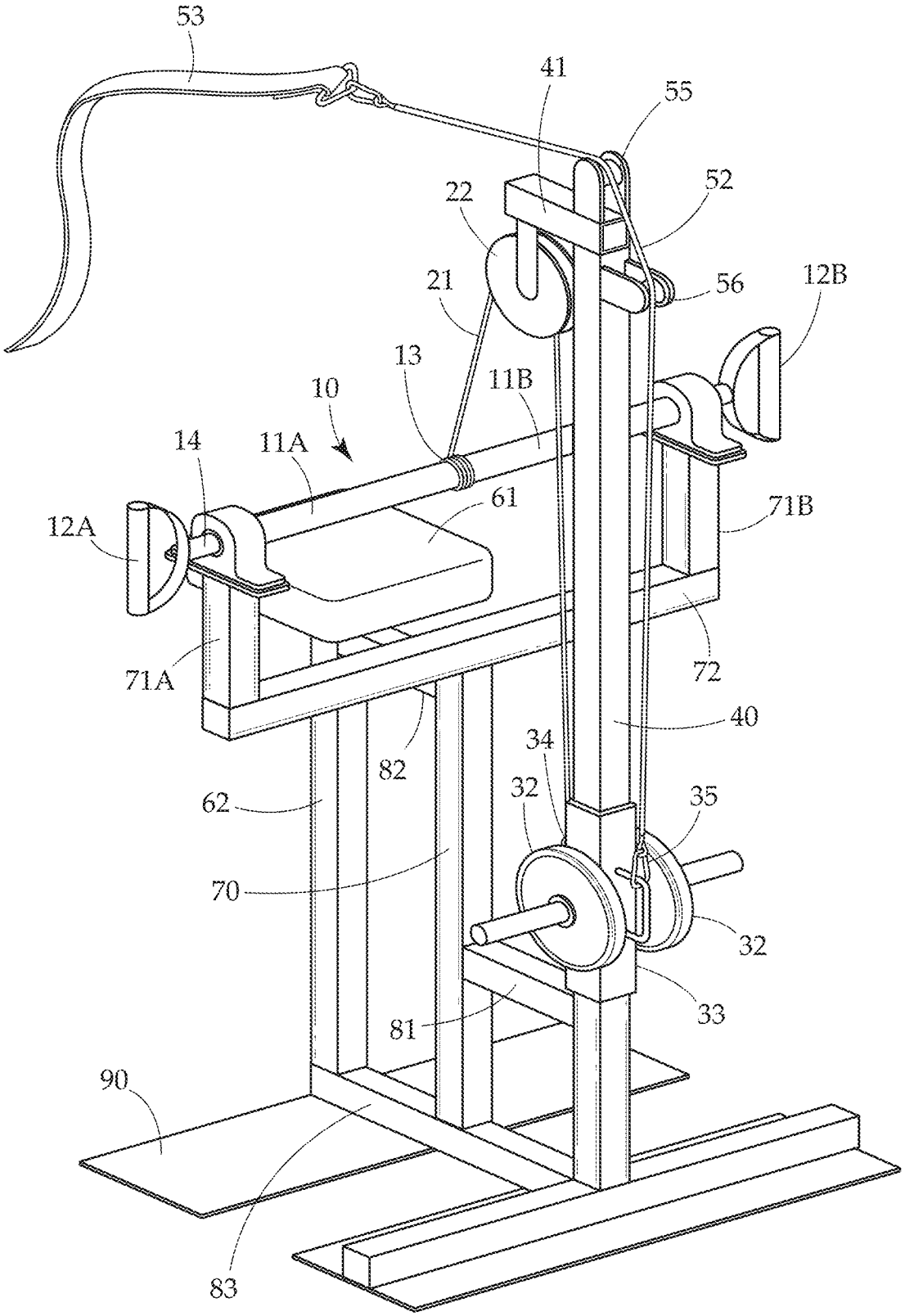
FIG. 1 is an isometric diagram illustrating the structure of a strength training device for arm-wrestlers, according to some embodiments of the present disclosure.

In order to more clearly illustrate the technical solutions of the embodiments of the present disclosure, the accompanying drawings for the description of the embodiments are described below. Obviously, the accompanying drawings in the following description are only some examples or embodiments of the present disclosure, and it is possible for a person of ordinary skill in the art to apply the present disclosure to other similar scenarios in accordance with these accompanying drawings without creative labor. Unless obviously obtained from the context or the context illustrates otherwise, the same numeral in the drawings refers to the same structure or operation.

It should be understood that the terms "system," "device," "unit," and/or "module" are used herein as a way to distinguish between different components, elements, parts, sections, or assemblies at different levels. However, if other words may achieve the same purpose, the terms may be replaced with alternative expressions.

As indicated in the present disclosure and in the claims, unless the context clearly suggests an exception, the words "one," "a," "a kind of," and/or "the" do not refer specifically to the singular but may also include the plural. In general, the terms "include" and "comprise" suggest only the inclusion of clearly identified steps and elements, which do not constitute an exclusive list, and the method or device may also include other steps or elements.

Figure 3:
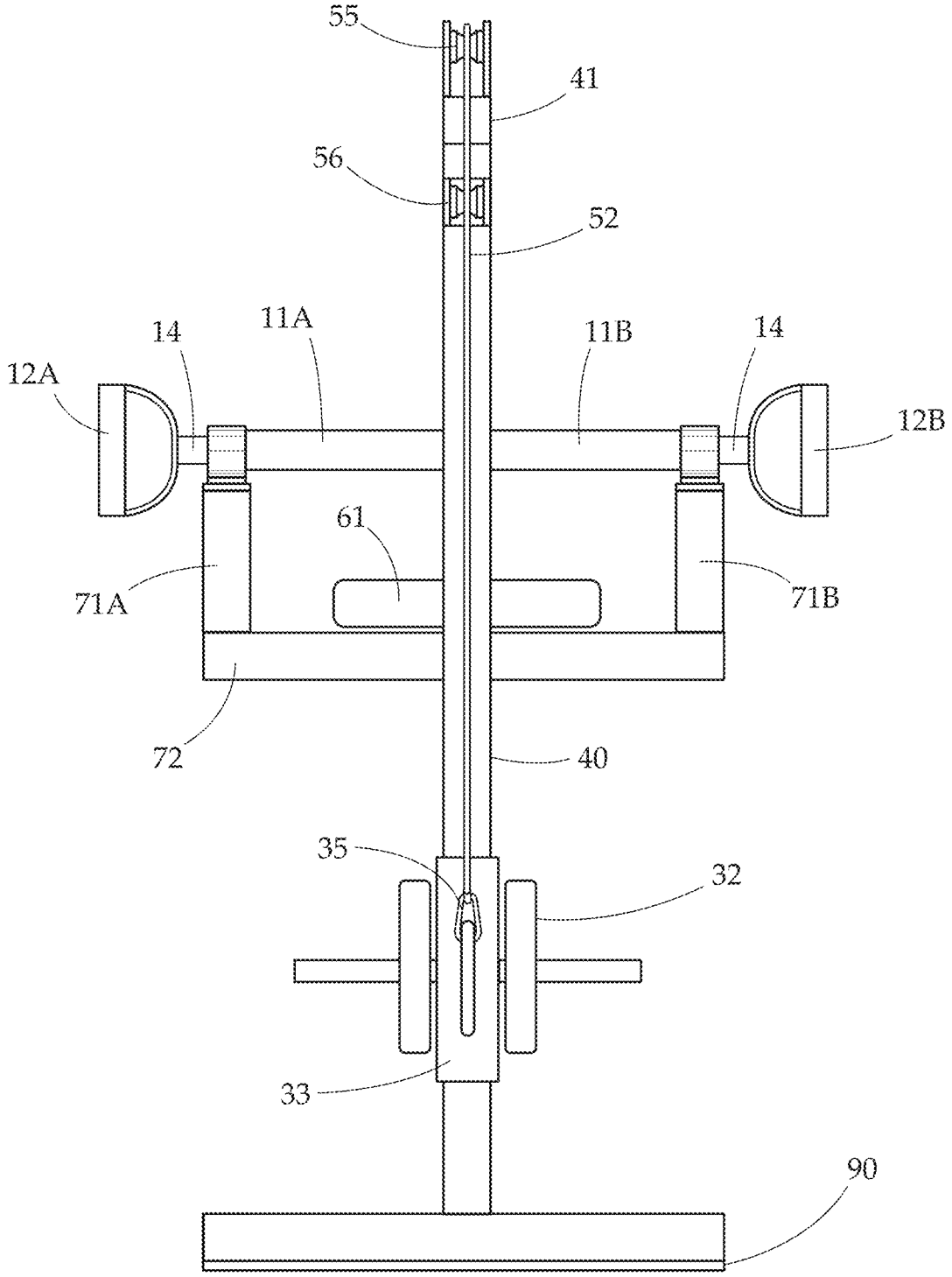
FIG. 3 is a front-view diagram illustrating the structure of the strength training device for arm-wrestlers, according to some embodiments of the present disclosure.
Figure 4:
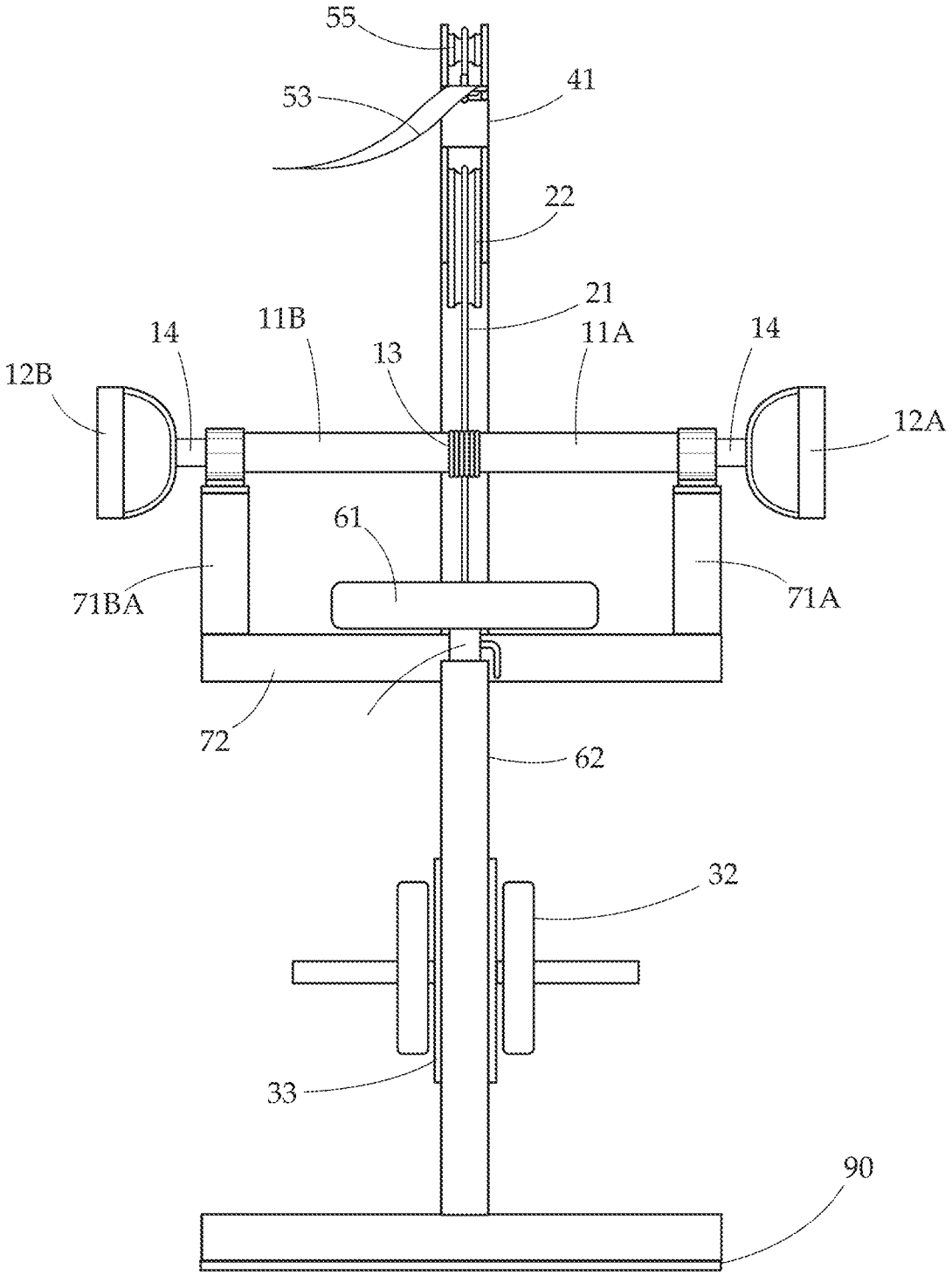
FIG. 4 is a back-view diagram illustrating the structure of the strength training device for arm-wrestlers, according to some embodiments of the present disclosure.
Figure 5:
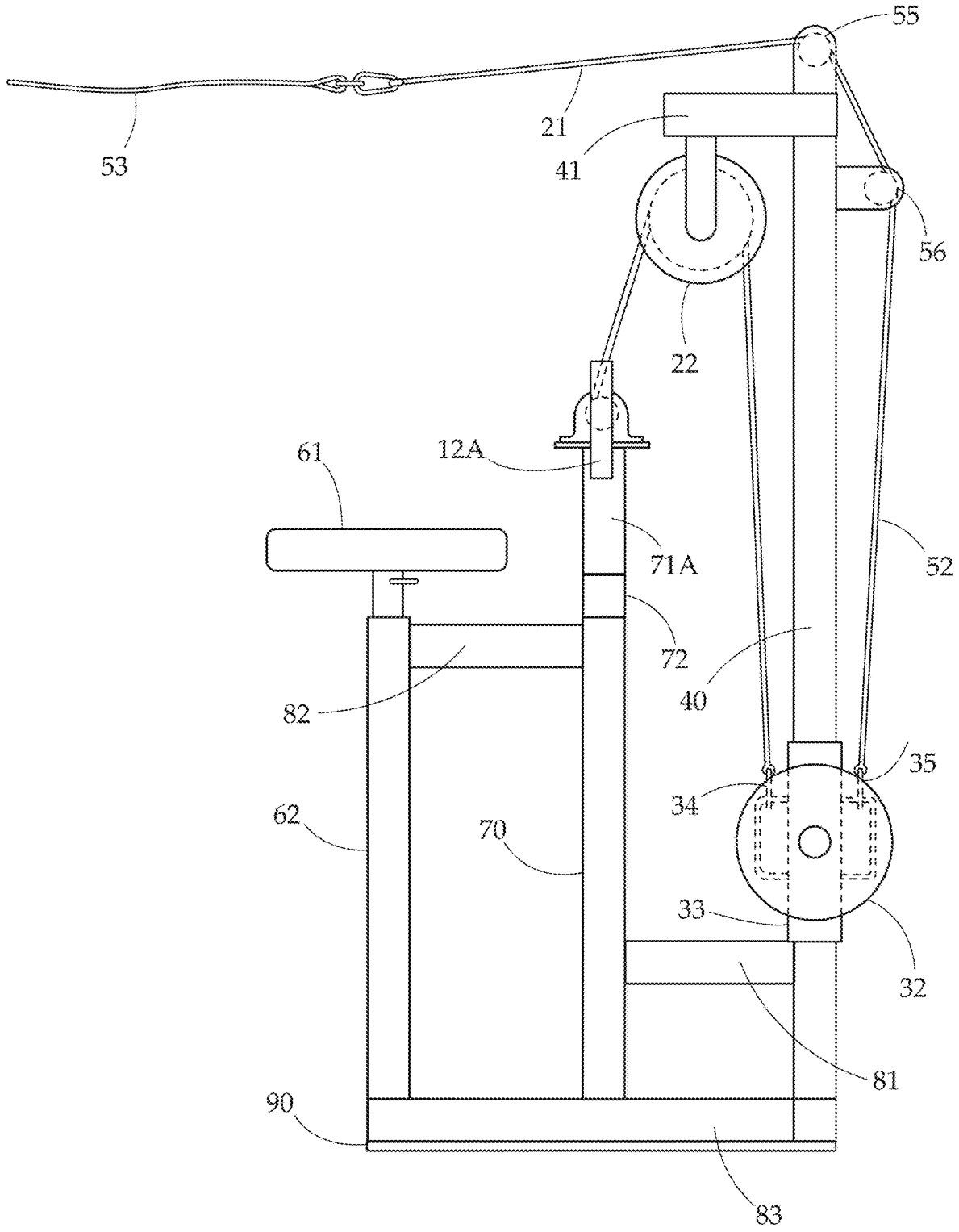
FIG. 5 is a side-view diagram illustrating the structure of the strength training device for arm-wrestlers, according to some embodiments of the present disclosure.

FIG. 1 is an isometric diagram illustrating the structure of a multi-use strength training device for arm wrestlers, according to some embodiments of the present disclosure. Additionally, FIGS. 3-5 are, respectively, a front-view diagram, a back-view diagram, and a side-view diagram thereof.

As shown in FIG. 1, in some embodiments, a central piece of the presently disclosed training device is a forearm-and-wrist roller 10, mounted onto and stabilized by a first vertical pole 70. As discussed in the background section, this change over the start-of-the-art forearm-and-wrist rollers, which are designed as stand-alone pieces, could eliminate the need for a trainer to support the weight of the roller during the training, thus enabling the trainer to focus their strength on the movement of forearms and wrists.

In some embodiments, the forearm-and-wrist roller 10 includes a first horizontal bar 14. Wherein, in some embodiments, the first horizontal bar 14 may be cylindrical and elongated in an axial direction. Wherein, in some embodiments, the first horizontal bar 14 may rotate about its central axis.

The forearm-and-wrist roller 10 may include a first pair of handles 11-*a* and 11-*b*, one on each side of the midpoint 13 of the first horizontal bar 14. Wherein, in some embodiments, the first pair of handles 11-*a* and 11-*b* may be implemented by wrapping ropes, foams, rubber, or other textured materials that offer sufficient friction between a trainer's hands and the first horizontal bar 14 around the bar. Alternatively, the first pair of handles 11-*a* and 11-*b* may be implemented by adding texture on the surface of the bar first horizontal 14 to increase friction and indicate where a trainer should put their hands onto the bar. The first pairs of handles may be along the axial direction of the first horizontal bar 14. The first pair of handles 11-*a* and 11-*b* may be symmetrical about the midpoint 13 of the first horizontal bar 14. A trainer may hold onto the first pair of handles 11-*a* and 11-*b* to rotate the first horizontal bar 14 about its central axis in either direction, which will be discussed in greater detail in the later sections.

In some embodiments, the first horizontal bar 14 may also include a second pair of handles 12-*a* and 12-*b* attached to each end of the bar. In some embodiments, the second pair of handles 12-*a* and 12-*b* may be perpendicular to the axial direction of the first horizontal bar 14. In some embodiments, the second pair of handles may be symmetrical about the central axis of the first horizontal bar 14. In some embodiments, the second pair of handles 12-*a* and 12-*b* may be symmetrical about the midpoint 13 of the first horizontal bar 14. A trainer may stand on one side of the first horizontal bar 14 and hold onto one of the handles 12-*a* or 12-*b* among the second pair of handles, either by one hand, or by two hands alternatively, to turn the first horizontal bar 14 in either direction, which will be discussed in greater detail in later sections. Among the second pair of handles 12-*a* and 12-*b*, the left-hand handle may be labeled as 12-*a*, and the right-hand handle may be labeled as 12-*b*.

In some embodiments, the first horizontal bar 14 is mounted onto the first vertical pole 70 via a pair of supporting columns 71-*a* and 71-*b* and a second horizontal bar 72. In some embodiments, the pair of supporting columns 71-*a* and 71-*b* are respectively placed between the first pair of handles 11-*a* and 11-*b* and the second pair of handles 12-*a* and 12-*b*. In some embodiments, each of the pair of supporting columns 71-*a* and 71-*b* may include a hole for the first horizontal bar 14 to pass through. In some embodiments, the pair of supporting columns 71-*a* and 71-*b* may be identical and symmetrical about an axial cross-section passing the midpoint 13 of the first horizontal bar 14. In some embodiments, the second horizontal bar 72 may be attached between the bottom ends of the pair of supporting columns 71-*a* and 71-*b*. In some embodiments, the first vertical pole 70 may be attached to the bottom of the second horizontal bar 72 at a midpoint of the second horizontal bar, which may align with the midpoint 13 of the first horizontal bar 14.

In some embodiments, a first rope 21 may be tied to a midpoint 13 of the first horizontal bar 14. The other side of the first rope 21 may be tied to a weight assembly 30 via a first fixed pulley 22. Wherein, the weight assembly 30 is connected to a second vertical pole 40 in such a way that it may move along the second vertical pole in either the upward direction or the downward direction. The first rope 21 may wrap around an axial cross-section of the first horizontal bar 14 at its midpoint 13, in either direction, when the first horizontal bar 14 rotates along its central axis. Therefore, when a trainer turns the first horizontal bar 14 in either direction, the first rope 21 may wrap around the first horizontal bar 14 to pull the weight assembly 30 up. When the trainer releases the first horizontal bar 14, the weight assembly 30 may be pulled down by gravity, thus unwrapping the first rope 21 around the bar. In some embodiments, the first rope 21, the first fixed pulley 22, and the second vertical pole 40 may all reside on the vertical plane passing the midpoint of the first horizontal bar 14 and perpendicular to the first horizontal bar.

In some embodiments, the second vertical pole 40 may connect to a third horizontal bar 41 on its top. In some embodiments, the third horizontal bar 41 may be very short in length compared to the second vertical pole 40. In some embodiments, the third horizontal bar 41 may be perpendicular to both the second vertical pole 40 and the first horizontal bar 14. In some embodiments, the first fixed pulley 22 may connect to a bottom side of the third horizontal bar 41.

In some embodiments, the weight assembly 30 includes a fourth horizontal bar 31. In some embodiments, a midpoint of the fourth horizontal bar 31 may align with the second vertical pole 40 and may connect to the second vertical pole via a guideway 33, so that the fourth horizontal bar may move upward or downward along the second vertical pole 40. A first clip 34 may be attached to a front side of the guideway 33, so that the first rope 21 may detachably connect to the weight assembly 30 via the first clip. Weight plates 32 may be put onto and removed from each side of the fourth horizontal bar 31, so that the force required to pull up the weight assembly 30 may be adjusted.

In some embodiments, the weight assembly 30 may be implemented in other ways deemed obvious in the eyes of a person with ordinary skills in the art. For one example, the weight plates 32 may be stacked in the vertical direction instead of the horizontal direction. For another example, a selectorized pin, attached to a cable or pin, may be used to adjust the weight, so that the weights do not have to be attached to or removed from the weight assembly. For another example, a spring with adjustable strength may be used to replace the weight assembly.

In some embodiments, the weight assembly 30 may include a second clip 35 attached to a back side of the guideway 33. A second rope 52 may be attached to the weight assembly 30 via the second clip 35. In some embodiments, the second rope 52 may go through a second fixed pulley 55, which may be located on a back side of the second vertical pole 40, and a third fixed pulley 56, which may be located on a top side of the third horizontal bar 41.

In some embodiments, the other end of the second rope 52 may detachably connect to either a grip 53 or a third handle 54. In some embodiments, such detachable connections are implemented as clip connections. In some embodiments, both end of the second rope 52 may include rings or clips, so that it can detachably connect to the second clip 35, the grip 53, or the third handle 54 via clip connections. In some embodiments, the grip 53 may be implemented as a long strip of fiber, with a rough texture to provide sufficient friction. In some embodiments, the grip 53 may align with a direction of tension in the second rope 52 at a connection between the grip and the second rope. In some embodiments, the third handle 54 may be perpendicular to the direction of tension in the second rope 52 at a connection between the third handle and the second rope. This difference between the grip 53 and the third handle 54 means that different groups of muscles are exercised with the use of the grip or the third handle. In some embodiments, when a user pulls the second rope 52 by the grip 53 or the third handle 54, the weight assembly 30 may move upward, which will be discussed in detail in the later sections.

In some embodiments, the presently disclosed device may further include a cushion 61 in front of the forearm-and-wrist roller 10. In some embodiments, a trainer may rest and stabilize their elbow on the cushion 61 when pulling the second rope 52 by the grip 53 or the third handle 54. In some embodiments, the cushion 61 may be made of foam covered in leather, to absorb the impact and provide enough friction to stabilize a trainer's arm. In some embodiments, the cushion 61 may also be made of other materials serving the same purpose, deemed obvious in the eyes of a person with ordinary skills in the art.

In some embodiments, the cushion 61 is mounted onto a third vertical pole 62. In some embodiments, the height of the third vertical pole 62 may be adjusted. In some embodiments, the third vertical pole 62 may be implemented as an adjustable telescopic pole. Wherein, the third vertical pole 62 may include an upper part and a lower part, and each part may contain a series of holes along a column, which can be aligned and secured using screws to fix the desired length.

In some embodiments, a fourth horizontal bar 81 may connect the first vertical pole 70 and the second vertical pole 40 for supporting purposes. In some embodiments, the weight assembly 30 may rest above and be supported by the fourth horizontal bar 81 when neither the first rope 21 nor the second rope 52 is pulled. In some embodiments, a fifth horizontal bar 82 may connect the third vertical pole 62 and the first vertical pole 70 for supporting purposes. In some embodiments, a sixth horizontal bar 83 may be placed at or near the bottom of the presently disclosed device, to connect the first vertical pole 70, the second vertical pole 40, and the third vertical pole 62. In some embodiments, the numbers and locations of the horizontal bars connecting the vertical poles may differ. For example, two horizontal bars may be used to connect the first vertical pole 70, and the second vertical pole 40. For another example, there may be no horizontal bars between the first vertical pole and the second vertical pole, and the weight assembly 30 may rest on the base 90 or on the ground at its bottommost position.

In some embodiments, the first vertical pole 70, the second vertical pole 40, and the third vertical pole 62 may be mounted onto a base 90 to stabilize the structure of the presently disclosed device. In some embodiments, the base 90 may contain one or more pieces.

In some embodiments, the poles, the bars, and the base may be made of steel or other metal or materials with sufficient strength.

FIGS. 2A-D illustrate four methods of using the strength training device for arm-wrestlers, according to some embodiments of the present disclosure. As discussed in the background section, since arm-wrestling involves different groups of wrist and forearm muscles, it could be beneficial to incorporate different functions into one training device.

Figure 2A:
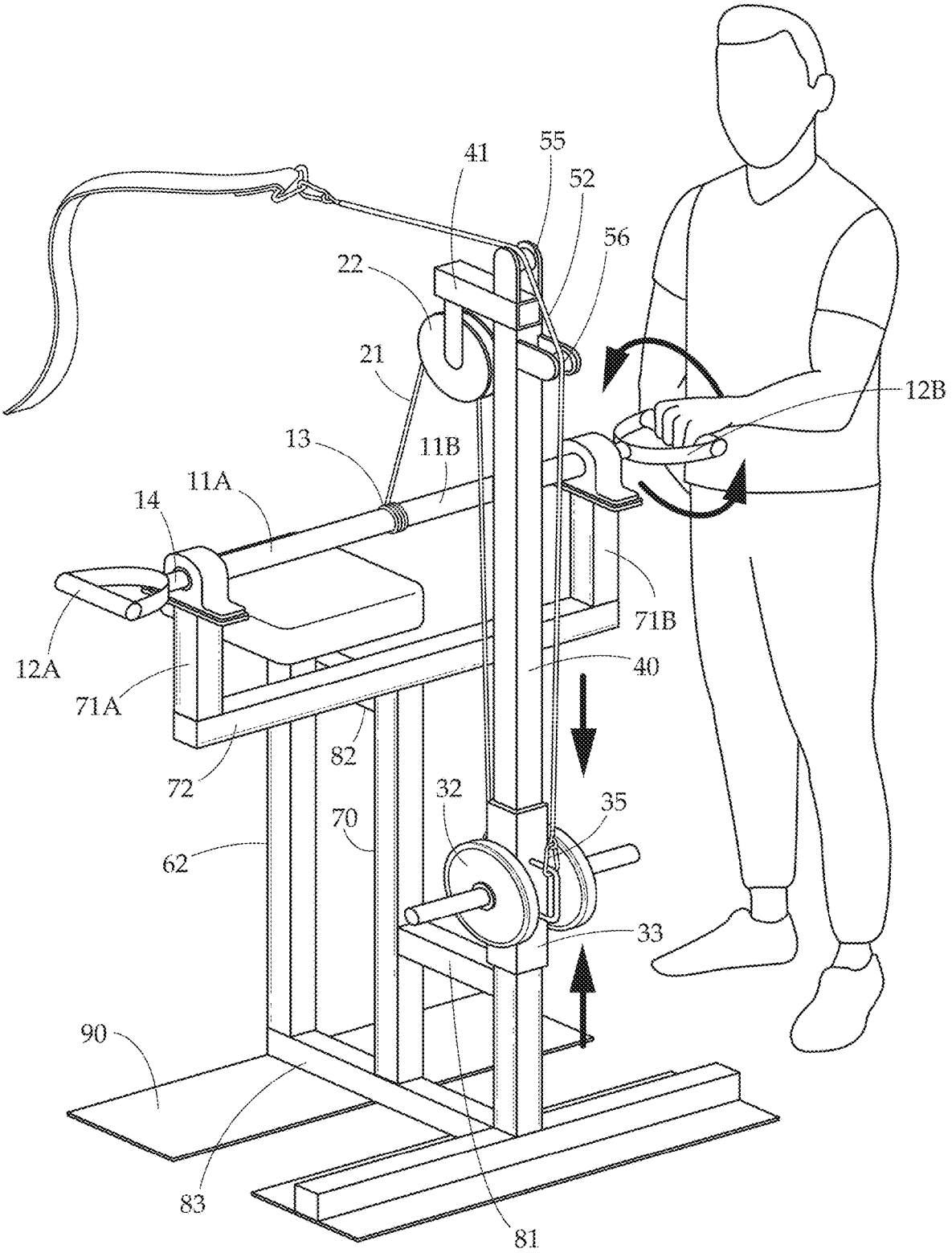
FIG. 2A illustrates a first method of using the strength training device for arm-wrestlers, according to some embodiments of the present disclosure.

FIG. 2A illustrates the first method of training. Wherein, the trainer may stand behind the cushion 61 and face the forearm-and-wrist roller 10. The trainer may put their hands on the first pair of handles 11-*a* and 11-*b*. The trainer may rotate the forearm-and-wrist roller 10 in either direction about its central axis with their wrist movements. As discussed above, the first rope 21 may wrap around an axial cross-section of the first horizontal bar 14 at its midpoint 13 and pull the weight assembly 30 up via the first fixed pulley 22. Also as discussed above, when the trainer releases the forearm-and-wrist roller 10, gravity may pull the weight assembly 30 down, thus unwrapping the first rope 21 around the first horizontal bar 14.

When releasing the forearm-and-wrist roller 10, the trainer may wrap their hands loosely around the first pair of handles 11-*a* and 11-*b* to increase the friction between their hands and the first pair of handles. By doing that, the trainer may slow down the downward movement of the weight assembly 30 to avoid excessive impact when the weight assembly reaches its bottommost position and lands upon the fourth horizontal bar 81 or other supporting structures or surfaces.

As discussed above, the trainer may put the weight plates 32 onto or remove the weights from the weight assembly 30 to adjust the force required to rotate the forearm-and-wrist roller 10 in either direction.

Figure 2B:
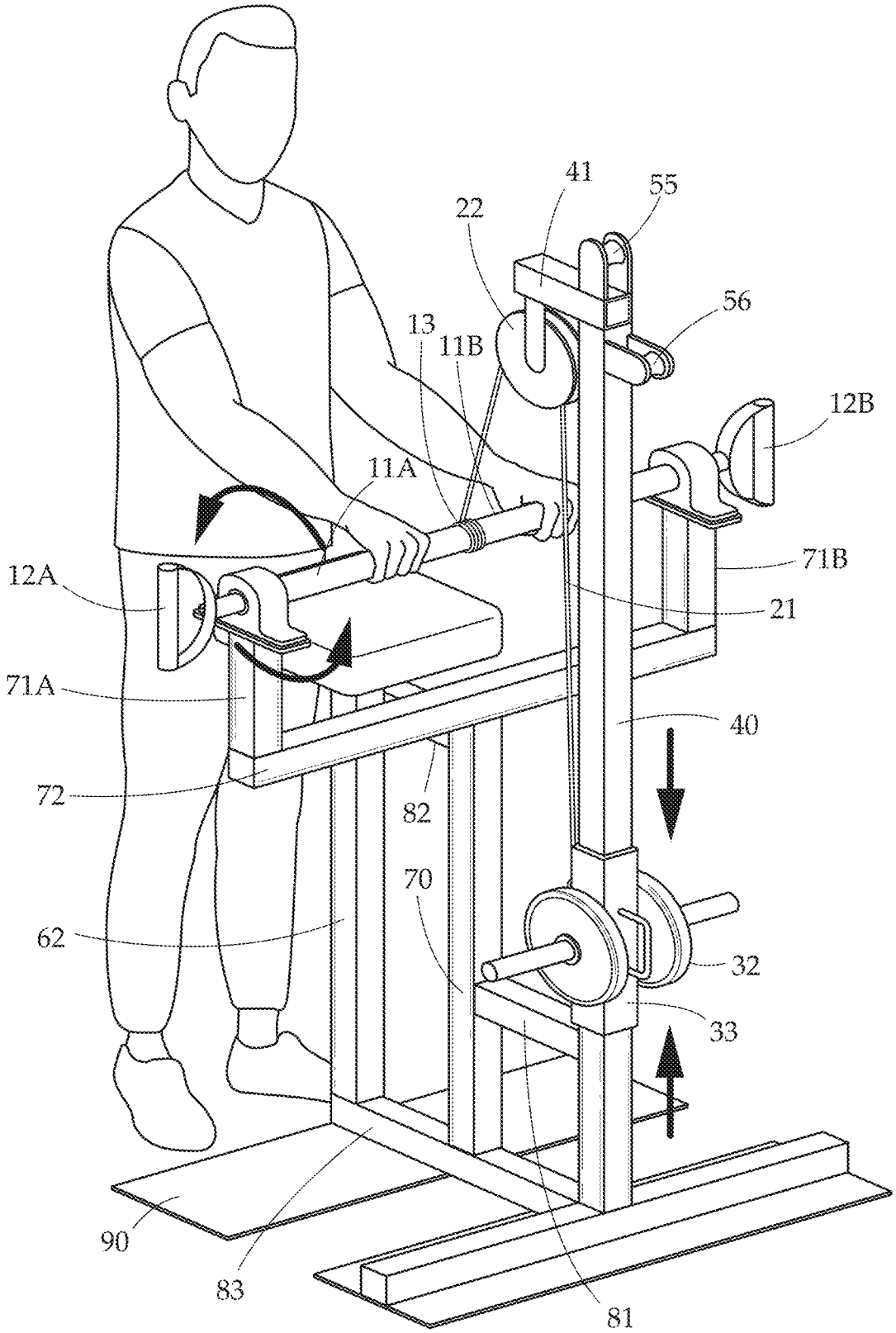
FIG. 2B illustrates a second method of using the strength training device for arm-wrestlers, according to some embodiments of the present disclosure.

FIG. 2B illustrates the second method of training. A trainer may stand on the right side of the forearm-and-wrist roller 10. Before the trainer starts exercising, the trainer may rotate the forearm-and-wrist roller 10 counterclockwise with both hands by the right-hand handle 12-*b* of the second pair of handles located on each side of the first horizontal bar 14. Hence, the weight assembly 30 may be pulled up from its relaxed position. After that, the trainer may hold the right-hand handle 12-*b* with their right hand and rotate the forearm-and-wrist roller 10 by twisting their right wrist and forearm back and forth. When the forearm-and-wrist roller 10 rotates counterclockwise, the first rope 21 may tighten and pull the weight assembly 30 up; when the forearm-and-wrist roller 10 rotates counterclockwise, the tension in the first rope 21 may get released and the weight assembly 30 may be pulled down by gravity and in turn partially unwraps the first rope. As discussed above, the force needed to turn the forearm-and-wrist roller 10 may be adjusted by adding or removing weight plates 32 from the weight assembly 30. If the trainer is left-handed or would like to strengthen their left wrist and forearm, they may do the same exercise with the left-hand handle 12-*a*.

Figure 2C:
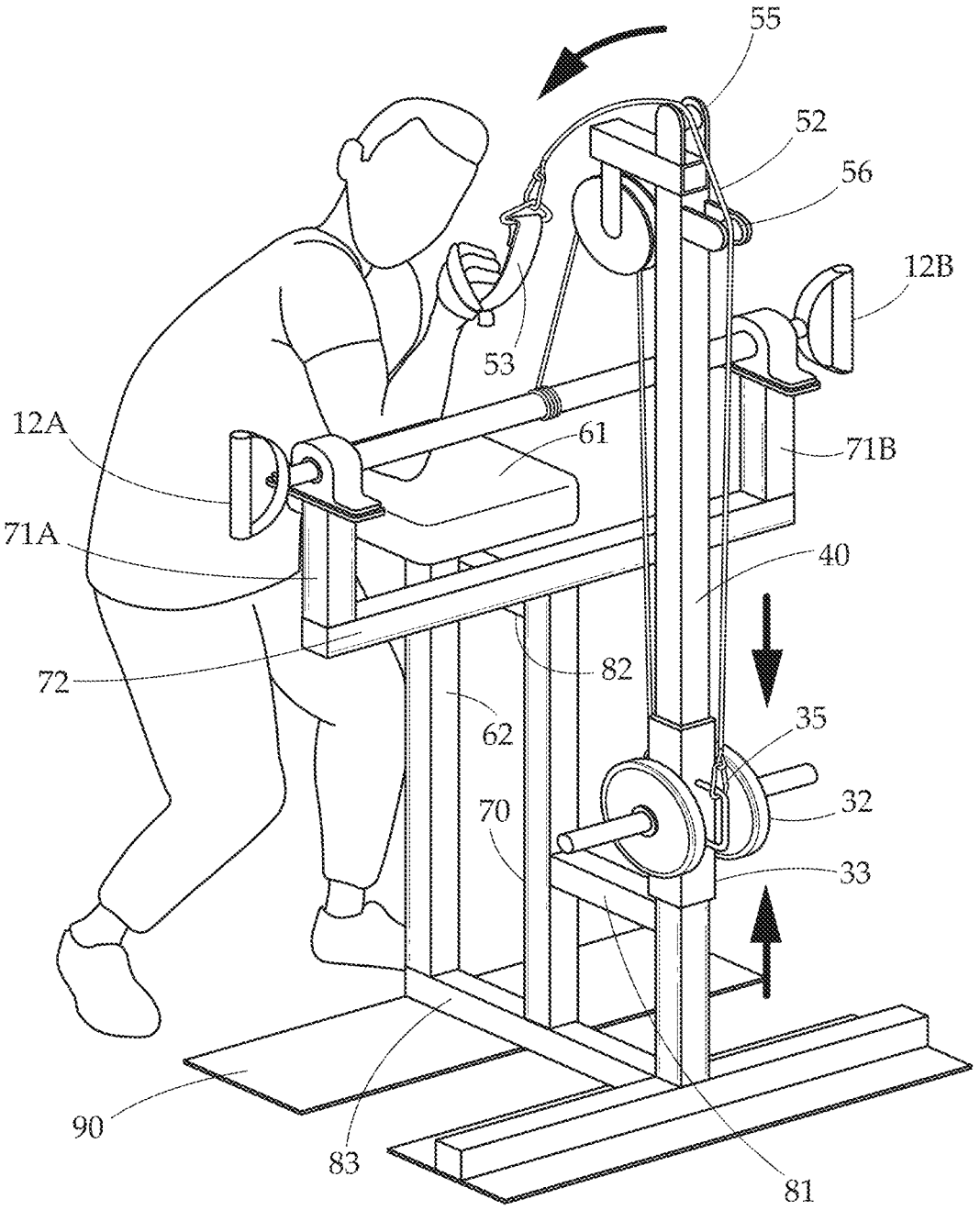
FIG. 2C illustrates a third method of using the strength training device for arm-wrestlers, according to some embodiments of the present disclosure.

FIG. 2C illustrates the third method of training. As discussed above, a trainer may attach a second rope 52 onto the weight assembly 30 via the second clip 35, and a grip 53 may be attached to the other end of the second rope. A trainer may grab the grip 53 with one of their hands and pull the weight assembly 30 up. When the trainer slowly releases the tension in the second rope 52, the weight assembly 30 may get dragged down by gravity, and the trainer may pull the weight assembly up again by the grip 53. This movement may be repeated a number of times in one group of exercises. As discussed above, the grip 53 may be implemented as a stripe of textured fiber. A trainer may choose to wrap the grip 53 around their palm or not. Also as discussed above, a trainer may place their elbow onto the cushion 61 to support and stabilize their arm, so that they may focus their strength on forearm and wrist movements.

Figure 2D:
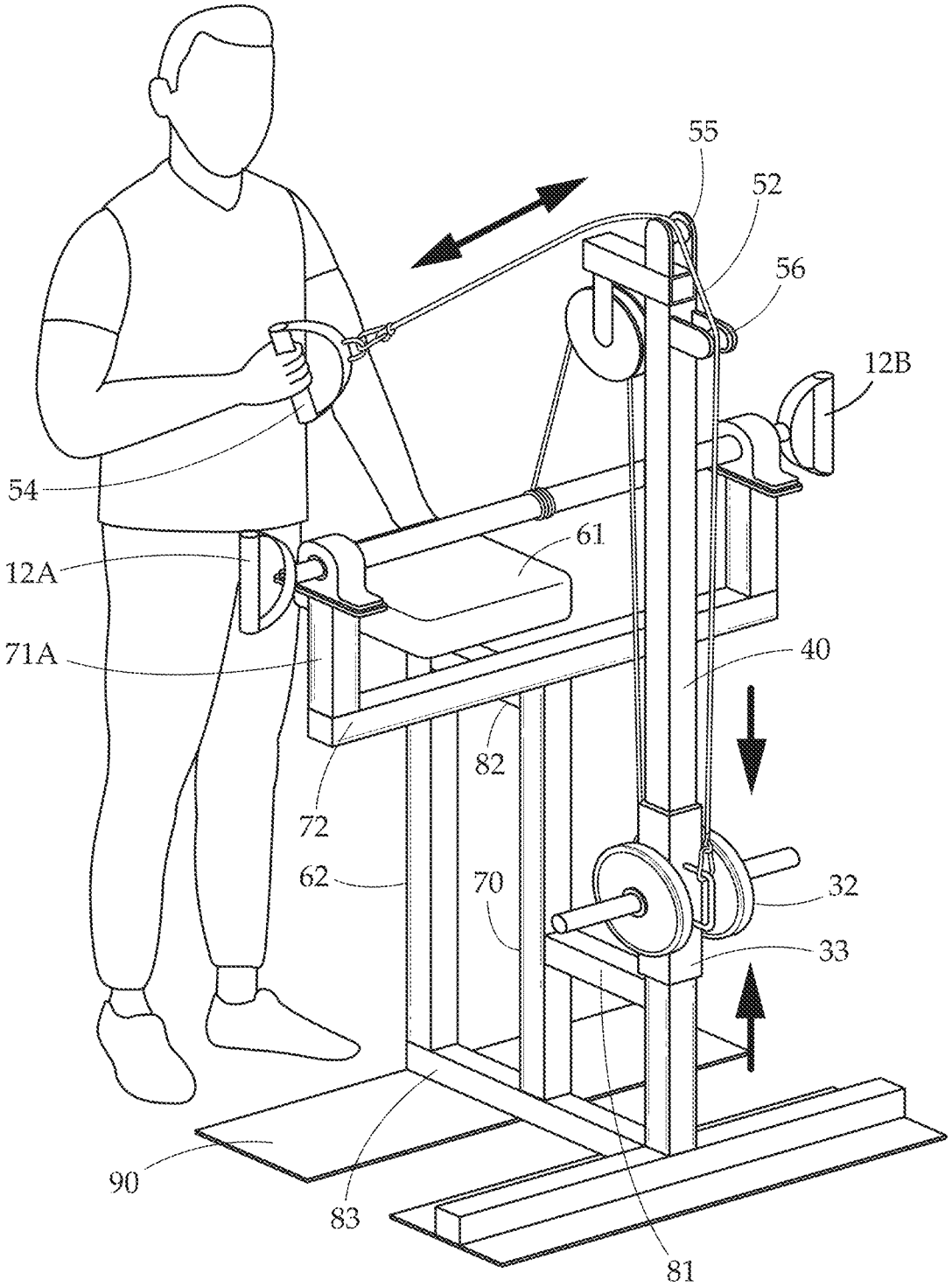
FIG. 2D illustrates a fourth method of using the strength training device for arm-wrestlers, according to some embodiments of the present disclosure.

FIG. 2D illustrates the fourth method of training. As discussed above, instead of the grip 53, a third handle 54 may be attached to the end of the second rope 52 opposite to the weight assembly 30. A trainer may grab the third handle 54 with one of their hands and pull the weight assembly 30 up. When the trainer slowly releases the tension in the second rope 52, the weight assembly 30 may get dragged down by gravity, and the trainer may pull the weight assembly up again by the third handle 54. This movement may be repeated a number of times in one group of exercises. As discussed above, in some embodiments, the grip 53 may align with the direction of tension in the second rope 52, whereas the third handle 54 may be perpendicular to the direction of tension in the second rope. Therefore, a trainer may exercise two different groups of muscles by repeatedly pulling the weight assembly 30 up using the grip 53 and the third handle 54. Also as discussed above, a trainer may place their elbow onto the cushion 61 to support and stabilize their arm, so that they may focus on their forearm and wrist movements.

Furthermore, unless explicitly stated in the claims, the use of order, numbers, letters, or other names for processing elements and sequences is not intended to limit the order of the processes and methods of the present disclosure. While various examples have been discussed in the disclosure as currently considered useful embodiments of the invention, it should be understood that such details are provided for illustrative purposes only. The appended claims are not limited to the disclosed embodiments, and instead, the claims are intended to cover all modifications and equivalent combinations within the scope and essence of the embodiments disclosed in the present disclosure. For example, although the described system components may be implemented through a hardware device, they may also be realized solely through a software solution, such as installing the described system on an existing processing or mobile device.

Similarly, it should be noted that, for the sake of simplifying the presentation of embodiments disclosed in the present disclosure and aiding in understanding one or more embodiments of the present disclosure, various features have been sometimes combined into a single embodiment, drawing, or description. However, this manner of disclosure does not imply that the features required by the claims are more than the features mentioned in the claims. In fact, the features of the embodiments are less than all the features of the single embodiment disclosed in the foregoing disclosure.

In some embodiments, numeric values describing the composition and quantity of attributes are used in the description. It should be understood that such numeric values used for describing embodiments may be modified with qualifying terms such as "about," "approximately" or "generally". Unless otherwise stated, "about," "approximately" or "generally" indicates that a variation of ±20% is permitted in the described numbers. Accordingly, in some embodiments, the numerical parameters used in the disclosure and claims are approximations, which can change depending on the desired characteristics of the individual embodiment. In some embodiments, the numerical parameters should take into account a specified number of valid digits and employ a general manner of bit retention. Although the numerical ranges and parameters used in some embodiments of the present disclosure to confirm the breadth of the range are approximations, in specific embodiments, such numerical values are set as precisely as practicable.

With respect to each of the patents, patent applications, publications of patent applications, and other material, such as articles, books, specifications, publications, documents and the like, cited in the present disclosure, the entire contents thereof are hereby incorporated herein by reference. Application history documents that are inconsistent with the contents of the present disclosure or that create conflicts are excluded, as are documents (currently or hereafter appended to the present disclosure) that limit the broadest scope of the claims of the present disclosure. It should be noted that in the event of any inconsistency or conflict between the descriptions, definitions, and/or use of terminology in the materials appended to the present disclosure and the contents described herein, the descriptions, definitions, and/or use of terminology in the present disclosure shall prevail.

In closing, it should be understood that the embodiments described in the present disclosure are used only to illustrate the principles of the embodiments of the present disclosure. Other deformations may also fall within the scope of the present disclosure. Therefore, by way of example and not limitation, alternative configurations of the embodiments disclosed in the present disclosure may be considered consistent with the teachings of the present disclosure. Accordingly, the embodiments described in the present disclosure are not limited to the explicitly introduced and described embodiments in the present disclosure.

What is claimed is:

1. A multi-use strength training device for arm-wrestlers, comprising:

a forearm-and-wrist roller fixedly mounted onto a first vertical pole, which further includes:

a first horizontal bar able to rotate about a central axis;

a first pair of handles on and aligning with the first horizontal bar, on each side of a midpoint of the first horizontal bar; and a second pair of handles respectively attached to each end of the first horizontal bar and perpendicular to the first horizontal bar;

a first rope connecting the midpoint of the first horizontal bar and a weight assembly via a first fixed pulley;

wherein, the weight assembly is able to move along a second vertical pole;

wherein, the first fixed pulley is mounted onto the second vertical pole;

wherein, when the first horizontal bar rotates in either direction, the first rope wraps around the first horizontal bar at the midpoint of the first horizontal bar, and pulls the weight assembly up along the second vertical pole;

wherein, when a tension in the first rope gets released, gravity drags the weight assembly down along the second vertical pole, which in turn unwraps the first rope around the first horizontal bar, and rotates the first horizontal bar;

wherein, a weight in the weight assembly is adjustable;

a second rope, with one end detachably connecting to the weight assembly and the other end detachably connecting to a grip or a third handle via one or more second fixed pulleys;

wherein, the one or more second fixed pulleys are mounted onto the second vertical pole.

2. The device in claim 1, wherein the first pair of handles is formed by wrapping two pieces of textured materials around the first horizontal bar.

3. The device in claim 1, wherein the grip is a stripe of textured material.

4. The device in claim 1, wherein the third handle is perpendicular to a direction of tension in the second rope when the second rope is tightened.

5. The device in claim 1, which further includes a third vertical pole, wherein a cushion is mounted onto the third vertical pole.

6. The device in claim 5, wherein the third vertical pole is telescopic with an adjustable height.

7. The device in claim 5, further comprising one or more supporting bars connecting two or all of the first vertical pole, the second vertical pole, and the third vertical pole.

8. The device in claim 5, wherein the first vertical pole, the second vertical pole, and the third vertical pole are mounted onto a base comprising one or more base pieces.

9. The device in claim 5, further comprising a second supporting bar connecting the first vertical pole and the third vertical pole.

10. The device in claim 1, wherein a set of weight plates can be placed onto or removed from the weight assembly to adjust the weight in the weight assembly.

11. The device in claim 10, wherein the weight assembly further includes:

a guideway enabling the weight assembly to move along the second vertical pole;

a third horizontal bar attached to the guideway;

wherein, the set of weight plates can be placed onto or removed from the third horizontal bar.

12. The device in claim 10, wherein the weight assembly is supported by the first supporting bar at a bottommost position of the weight assembly.

13. The device in claim 1, wherein the second rope is detachably connected to the weight assembly via a first clip.

14. The device in claim 1, wherein the second rope is detachably connected to the grip or the third handle via a second clip.

15. The device in claim 1, further comprising a first supporting bar connecting the first vertical pole and the second vertical pole.

16. A method of training for arm-wrestlers on a multi-use strength training device, comprising:

wherein the multi-use strength training device includes:

a forearm-and-wrist roller fixedly mounted onto a first vertical pole, which further includes:

a first horizontal bar able to rotate about a central axis;

two pieces of textured materials wrapped around the first horizontal bar on each side of a midpoint of the first horizontal bar, forming a first pair of handles; and a second pair of handles respectively attached to each end of the first horizontal bar and perpendicular to the first horizontal bar; and a first rope connecting the midpoint of the first horizontal bar and a weight assembly via a first fixed pulley;

wherein, the weight assembly is able to move along a second vertical pole;

wherein, the first fixed pulley is attached to a bottom side of a second horizontal bar, which is attached to a top of the second vertical pole;

wherein, when the first horizontal bar rotates in either direction, the first rope wraps around the first horizontal bar at the midpoint of the first horizontal bar, and pulls the weight assembly up along the second vertical pole;

wherein, when a tension in the first rope gets released, gravity drags the weight assembly down along the second vertical pole, which in turn unwraps the first rope around the first horizontal bar, and rotates the first horizontal bar;

wherein, a weight in the weight assembly is adjustable;

holding onto the first pair of handles with both hands;

rotating the first horizontal bar in either direction, which wraps the first rope around the first horizontal bar and in turn pulls the weight assembly up; and releasing the first horizontal bar.

17. The method of training in claim 16, wherein the releasing of the first horizontal bar further includes:

wrapping both hands loosely around the first pair of handles to slow down the downward movement of the weight assembly.

18. The method of training in claim 16, wherein the weight assembly further includes:

a guideway enabling the weight assembly to move along the second vertical pole;

a third horizontal bar attached to the guideway;

a set of weight plates that are able to be placed onto or removed from the third horizontal bar to adjust the weight in the weight assembly.

19. A method of training for arm-wrestlers on a multi-use strength training device, comprising:

wherein the multi-use strength training device includes:

a forearm-and-wrist roller fixedly mounted onto a first vertical pole, which further includes:

a first horizontal bar able to rotate about a central axis;

two pieces of textured materials wrapped around the first horizontal bar on each side of a midpoint of the first horizontal bar, forming a first pair of handles;

a second pair of handles respectively attached to each end of the first horizontal bar and perpendicular to the first horizontal bar;

a first rope connecting the midpoint of the first horizontal bar and a weight assembly via a first fixed pulley;

wherein, the weight assembly is able to move along a second vertical pole;

wherein, the first fixed pulley is attached to a bottom side of a second horizontal bar, which is attached to a top of the second vertical pole;

wherein, when the first horizontal bar rotates in either direction, the first rope wraps around the first horizontal bar at the midpoint of the first horizontal bar, and pulls the weight assembly up along the second vertical pole;

wherein, when a tension in the first rope gets released, gravity drags the weight assembly down along the second vertical pole, which in turn unwraps the first rope around the first horizontal bar, and rotates the first horizontal bar;

wherein, a weight in the weight assembly is adjustable;

standing on one side of the forearm-and-wrist roller;

bringing the weight assembly up by using both hands to alternatively rotate a target handle in the second pair of handles in either direction;

using one hand to hold the target handle;

twisting the first horizontal bar back and forth.

20. The method of training in claim 19, wherein the weight assembly further includes:

a guideway enabling the weight assembly to move along the second vertical pole;

a third horizontal bar attached to the guideway;

a set of weights that are able to be placed onto or removed from the third horizontal bar to adjust the weight in the weight assembly.

* * * * *